United States Patent [19]

Martin et al.

[11] Patent Number: 4,817,342

[45] Date of Patent: Apr. 4, 1989

[54] WATER/ABRASIVE PROPULSION CHAMBER

[75] Inventors: R. Craig Martin; Jerry P. Woodson, both of Houston, Tex.

[73] Assignee: Whitemetal Inc., Houston, Tex.

[21] Appl. No.: 111,299

[22] Filed: Oct. 22, 1987

Related U.S. Application Data

[63] Continuation-in-part of Ser. No. 73,571, Jul. 15, 1987, abandoned.

[51] Int. Cl.[4] ..... B24C 5/04

[52] U.S. Cl. ..... 51/439; 51/321; 51/427

[58] Field of Search ..... 51/439, 319, 320, 321, 51/410

[56] References Cited

U.S. PATENT DOCUMENTS

| | | | |
|---|---|---|---|
| 409,751 | 8/1889 | Mathewson | 51/439 |
| 998,762 | 7/1911 | Faller | 51/439 |
| 2,290,979 | 7/1942 | Luce | 51/439 |

FOREIGN PATENT DOCUMENTS

| | | | |
|---|---|---|---|
| 0780489 | 4/1935 | France | 51/439 |
| 2442105 | 7/1980 | France | 51/439 |
| 0197370 | 10/1985 | Japan | 51/439 |
| 0331919 | 9/1958 | Switzerland | 51/439 |
| 0356397 | 9/1931 | United Kingdom | 51/439 |
| 0722464 | 1/1955 | United Kingdom | 51/439 |

*Primary Examiner*—Frederick R. Schmidt
*Assistant Examiner*—Robert A. Rose
*Attorney, Agent, or Firm*—Dodge, Bush & Moseley

[57] ABSTRACT

A propulsion apparatus adapted for use in a liquid propelled abrasive cleaning system is disclosed in which high pressure water is injected coaxially in a bore of a housing to which a flow of air and abrasive is introduced. The high pressure water is introduced into the bore via a water injection member fixed in the bore. The water injection member has a cross-sectional area which is small compared to that of the bore. A first embodiment of the invention includes a wing shaped water injection member which extends diagonally across the bore of the housing. A second embodiment of the invention includes a sloping leading edge with low axle oblique surfaces serving to deflect abrasive particles around the member and back into a high velocity air/abrasive longitudinal flow. The leading edge of the water injection member is small compared to the widest part of the member in the bore thereby creating an air-foil effect for the air/abrasive mixture flow as it passes the injection member in the bore. The streamlined shape of the injection member decreases the erosion of it from the flow of air and sand entering the bore and creates coaxial acceleration of the abrasive particles downstream of the water injection member. Downstream of the water injection member, the air/abrasive flow is propelled by the high pressure water at great velocity via the outlet of the bore.

17 Claims, 3 Drawing Sheets

WATER/ABRASIVE PROPULSION CHAMBER

CROSS REFERENCE TO A RELATED APPLICATION

This application is a continuation-in-part of U.S. application Ser. No. 073,571, filed on July 15, 1987, now abandoned.

BACKGROUND OF THE INVENTION

1. Field of the Invention

This invention relates generally to propulsion chambers, sometimes called blast nozzles used in cleaning metal surfaces with abrasive particles propelled by a combination of liquid and air, and particularly to a new and improved blast nozzle apparatus in which high pressure water is injected substantially coaxially with a flow of a mixture of air and abrasive entering the apparatus for increased performance and service life.

2. Description of the Prior Art

In order to completely clean a corroded metal surface down to a "white" metal condition so that such surface can be painted to preserve the metal against deterioration, it has become common practice to use various abrasive blasting techniques where abrasive particles are propelled against the metal surface in order to dislodge the oxides, previously applied coatings, scale and other contaminants. One cleaning technique has involved a two-step process consisting of dry blasting to apparent white metal, followed by high pressure water blasting to remove contaminants and oxides from microscopic pits in the surface. Another more efficient process has involved a high pressure water jet of the wet jet abrasive blaster type that accelerates abrasive particles against the surface, propelled by both a high pressure, high velocity water jet and air, so that cleaning can be accomplished in a single step. The single step process is preferred because iron oxide "caps" on surface pits which may contain water soluble iron salts do not have sufficient time to form, as in the case of a two-step process, so that the salts are flushed out of the pits to provide a truly clean surface.

In most any water-wetted abrasive blasting operation, the principle problems are slow cleaning rate, i.e., "performance" and early erosion of the nozzle or propulsion chamber body by abrasive flow, which prevents the maintenance of a stable flow pattern. Erosion and wear within the propulsion chamber or at a location within the outlet nozzle member results in a concentration of the blast of abrasive particles, which will reduce productivity and cause wear through a nozzle body in a relatively short period of time, thus rendering the nozzle inoperative. Although there appears to be no way to prevent erosion and wear altogether in this type device, the invention described below provides a propulsion chamber design with remarkably reduced wear characteristics and improved cleaning or production rates as compared to prior devices.

IDENTIFICATION OF OBJECTS OF THE INVENTION

A primary object of the invention is to provide a new and improved propulsion chamber for water/abrasive blasting which achieves increased cleaning or performance rates above prior art devices.

Another objective of the invention is to provide a propulsion chamber with reduced internal wear characteristics thereby increasing the service life of the chamber and minimizing the number of adjustments of flow rate of the air/abrasive mixture applied to the device so as to maintain maximum cleaning rate during operation.

SUMMARY OF THE INVENTION

The objects identified above as well as other features and advantages of the invention are incorporated in a propulsion chamber which includes a housing having a bore formed therein defining a longitudinal axis. The bore has an inlet end and an outlet end and is substantially straight so as to define a path for a flow of air and abrasive through the bore from the inlet end of the bore. A water injection member is placed in the bore for injecting high pressure water substantially coaxially in the bore toward the outlet end.

Alternative embodiments of the water injection member are provided according to the invention. The water injection member, according to a first embodiment has lateral sides with top and bottom ends which are secured to radially opposite walls of the bore and is placed in the path of the flow of air and abrasive downstream of the inlet end. It has a cross-sectional area facing the flow path which is small relative to that of the bore. The shape of the water injection member operably facilitates the flow of air and abrasive around its lateral sides.

The water injection member of both alternative embodiments has an outlet orifice disposed substantially coaxially with the bore of the cylindrical housing. Each has a radially directed passage which communicates with the outlet orifice and a radially directed passage in the propulsion chamber housing to which pressurized water is applied.

The water injection member of the first embodiment has a shape defined by integral central, leading and lagging sections. The leading section faces the inlet end of the bore. The lagging section faces the outlet end of the bore. The radially directed passage of the water injection member is disposed in its central section.

The central section of the first embodiment has lateral sides which are substantially parallel to each other. The distance between the lateral sides of the central section defines the central section width. The leading section has lateral sides which angle inwardly respectfully from the central section lateral sides toward the longitudinal axis of the bore. The width of the leading lateral sides terminate at a leading side facing the inlet end of the bore. The leading side is small relative to the width of the central section.

The lagging section of the first embodiment has lateral sides which angle inwardly respectively from the central section lateral sides toward the longitudinal axis of the bore and terminate at a lagging side disposed toward the outlet end from the central section. The lagging section of he water injection member includes a slot opening at its lagging side. The slot extends toward the central section of the water injection member generally parallel to the longitudinal axis of the bore of the housing. The outlet orifice is placed in the slot and is directed coaxially with the bore of the housing toward the outlet end of the bore.

The outlet end of the bore according to the first embodiment includes a frusto-conical surface which slopes toward the longitudinal axis of the bore at the outlet end of the bore. The housing of the propulsion chamber includes a counterbore at its outlet end with threads to removably secure an outlet nozzle therein. The outlet nozzle includes an inlet with an inwardly directed frusto-conical surface which cooperates with the inwardly directed frusto-conical surface at the outlet end of the bore to form a substantially continuous inwardly directed frusto-conical surface from the outlet of the bore of the propulsion chamber housing to the inlet of the outlet nozzle.

The propulsion chamber of both alternative embodiments includes a water inlet member which is fixed to the outer surface of the housing about the radially directed passage of the water injection member. The water inlet member has a radial passage arranged to communicate with the radial passage of the water injection member. The inlet member has an inlet bore, adapted to receive pressurized water, which communicates with the inlet member radial passage.

According to a second embodiment of the invention, the water injection member has a bottom side secured to a wall of the bore of the housing. It has a top side which extends into the bore to a position beyond the longitudinal axis of the bore, but stops short of touching the other side of the bore.

The water injection member of the second embodiment includes a central section through which the radially directed passage is disposed. The top section has its top side disposed in said bore beyond the longitudinal axis of the bore. A leading section of the water injection member slopes downwardly from the top side of the central section toward the inlet end of the bore. A cylindrical liner, secured to the surface of the bore, has a slot in which the bottom side of the water injection member is disposed. The cylindrical liner and water injection member are fabricated of tungsten carbide.

The leading section of the second embodiment of the water injection member includes a leading edge which slopes downwardly from the top side of the central section toward the inlet end of the bore to the liner. The leading section has lateral surfaces which extend into the bore from the bottom side of the member. Complimentary oblique surfaces are formed in the leading section such that each of the oblique surfaces have a side which coterminates with a side of the other surface to form a downwardly sloping leading edge of the leading section. Each oblique surface includes a side which forms an edge in one of the two lateral surfaces.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown of which.

DESCRIPTION OF THE INVENTION

Description of a First Embodiment of the Invention

Figure 1:
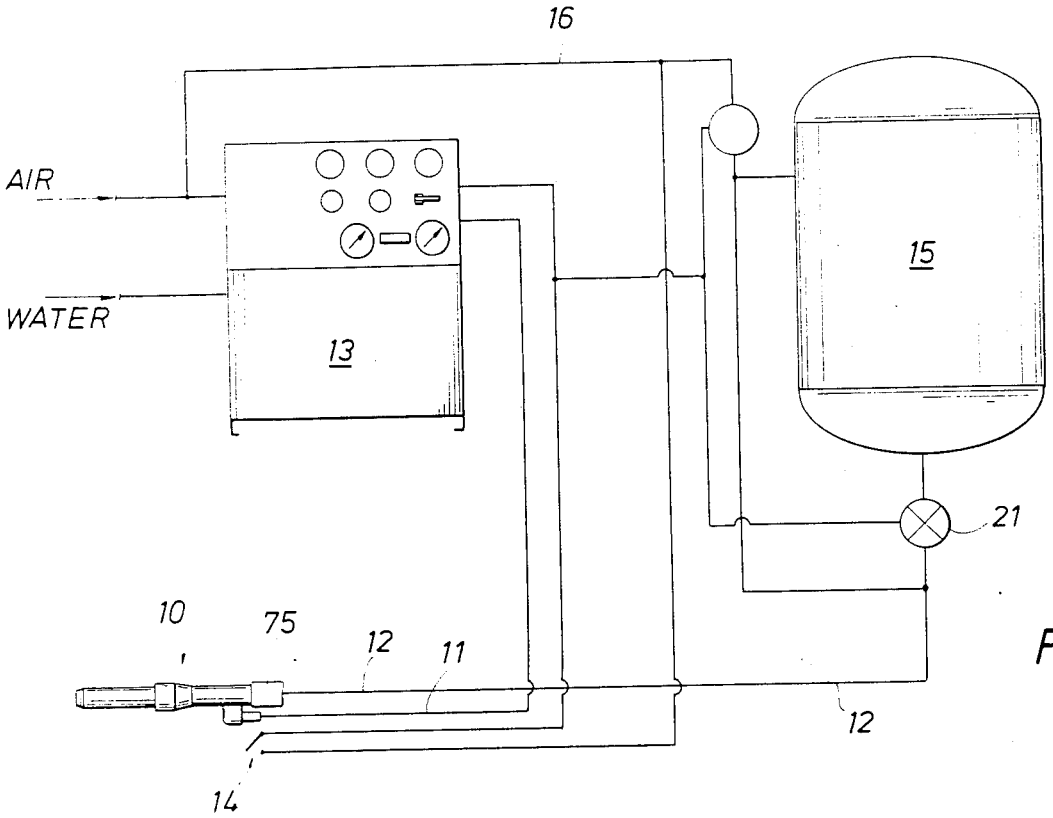
FIG. 1 is a schematic representation of a wet jet abrasive blast cleaning system which includes a propulsion chamber in accordance with this invention.

Referring initially to FIG. 1, a liquid-propelled abrasive blast system includes a propulsion apparatus 10, constructed in accordance with this invention, that is connected to the outer ends of a high pressure water supply hose or line 11 and a blast particle supply hose or line 12. The water line 11 leads to a portable control module 13 that houses a pump and other instrumentation and controls, and may be quite long, for example 250 feet, to enable the operator to conduct cleaning operations a substantial distance away. A normally closed "dead man" control valve 14 is mounted adjacent the propulsion apparatus 10 and functions to prevent operation of the propulsion apparatus 10 unless the control valve 14 is held open by depressing a spring-loaded lever.

A supply of abrasive particles, such as #3 sand, is contained in a tank or "pot" 15 which is sized to hold a selected quantity of abrasive, for example 1000 pounds. The tank 15 is pressurized by air pressure from a line 16. The sand supply hose 12 leads from the tank to an inlet coupling 75 of the propulsion apparatus 10 via a metering and shut-off valve 21. When the valve 21 is opened, a metered flow of abrasive particles is transported by compressed air through the supply hose 12 to the propulsion apparatus.

The sand particles are wetted and propelled within the propulsion apparatus 10 by a high velocity jet of water to produce a high pressure wetted abrasive that exits the apparatus 10. The blast of wetted abrasive is directed by the operator in a manner to provide highly effective cleaning of a metal or other surface such as concrete. Further details of the control module 13, the sand tank 15, and the various controls, pneumatic and hydraulic circuits by which one or more propulsion apparatuses can be operated are disclosed and claimed in U.S. application Ser. No. 872,095 filed June 6, 1986, which is assigned to the assignee of this invention and which is incorporated herein for all purposes.

Figure 2:
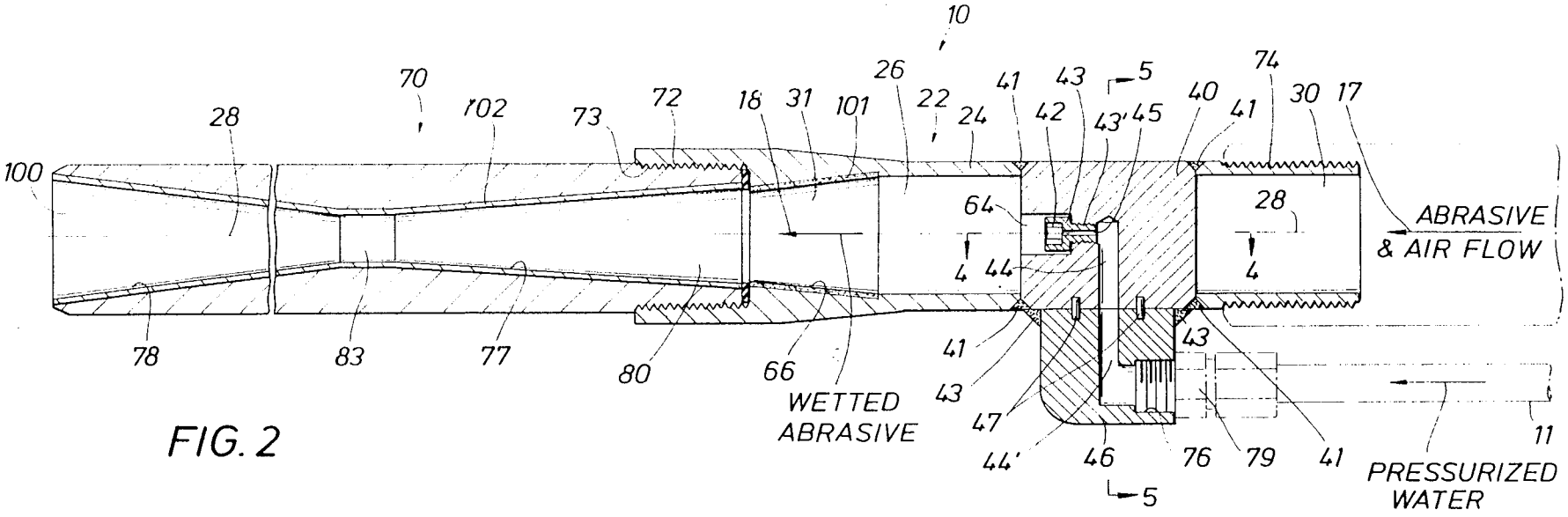
FIG. 2 is a cross-sectional view of a first embodiment of the propulsion chamber and an affixed outlet nozzle according.

As shown in FIG. 2, the propulsion apparatus 10 includes a propulsion chamber 22 and preferably an outlet nozzle 70 removably secured at the outlet end 31 of the propulsion chamber 22. The propulsion chamber includes a generally tubular housing 24 having a bore 26 formed therein defining a longitudinal axis 28. The bore includes an inlet end 30 about which external or male threads 74 are formed about the exterior of the housing 24. Coupling 75 of line 12 has cooperating internal or female threads (not shown) for connecting air/abrasive line 12 to the male threads 74 of propulsion chamber 22.

Figure 4:
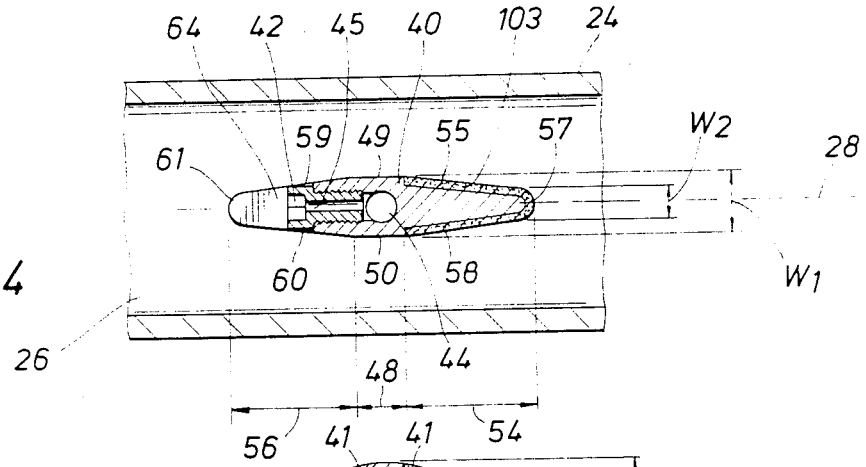
FIG. 4 is a cross-sectional view of the water injection member and a portion of the propulsion chamber housing according to the first embodiment of the invention, the view corresponding to the section lines 4—4 of FIG. 2.
Figure 5:
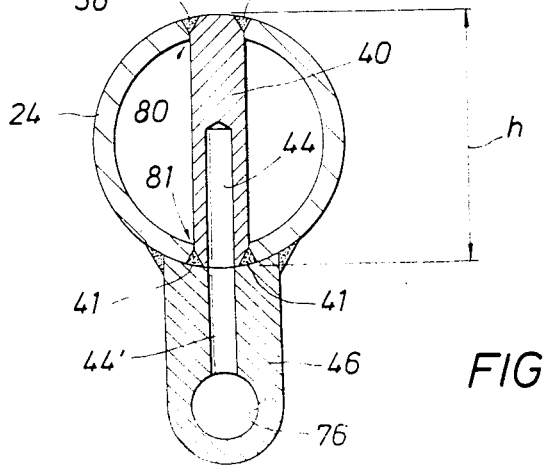
FIG. 5 is a cross-sectional view of the water injection member and water inlet member and a portion of propulsion chamber housing, the view corresponding to the section lines 5—5 of FIG. 2.

The bore 26 of housing 24 is substantially straight, defining a flow path for an entering flow of a mixture of abrasive and air, as indicated by arrow 17 and a water propelled flow of wetted abrasive as indicated by arrow 18. Between the inlet end 30 and the outlet end 31 of the propulsion chamber 22, a water injection member 40 is secured in the bore 26 directly in the flow path of the entering flow mixture of abrasive and air. As best seen in FIGS. 2, 4 and 5, the cross-sectional area of water injection member 40 which faces the bore flow path is small relative to that of the bore as seen from the flow path from the inlet end 30 toward the outlet end 31.

FIG. 4 best shows the size and orientation of water injection member 40 relative to the flow path of bore 26. The water injection member 40 includes integral sections, defined as central section 48, leading section 54 which faces inlet end 30, and lagging section 56 which faces outlet end 26. The central section has lateral sides 49, 50; the leading section has lateral sides 55, 56; and the lagging section has lateral sides 59, 60. As shown in FIGS. 2 and 5, the height of all the sides of all sections of the water injection member 40 are substantially the same. The height h of the water injection member 40 is illustrated in FIG. 5, which shows that the top and bottom ends of the water injection member 40 are secured by welds 41 in longitudinally oriented slots 80,81 of the housing 24.

The lateral sides 49, 50 of the central section are substantially parallel to the longitudinal axis 28 of the bore 26. The lateral sides 55, 56 of the leading section 54 angle inwardly toward the longitudinal axis 28 from their connection with central section sides 49 and 50 and terminate at a leading side 57. The width of leading side 57 is indicated by the dimension $w_2$. The width of the central section 48 is indicated by the dimension $w_1$. The width $w_2$ of the leading side 57 is smaller than the width $w_1$ of the central section and creates a leading shape similar to the leading edge of an airplane wing. Such "streamlined" or winged shape in the path of a flow of pressurized air and abrasive causes the flow of air and abrasive to flow past the water injection member 40 with minimal erosion of the leading side 57 in particular and the entire water injection member 40 in general.

The lagging or trailing end 56 of the water injection member 40 has its lateral sides 59, 60 angled inwardly toward the longitudinal axis 28 from their integral connection with central section sides 49, 50 as shown in FIG. 4. The sides 59, 60 terminate in a lagging side 61 which, like leading side 57, has a width smaller than the width $w_1$, of the central section.

A slot 64 is formed in the lagging side 61 and extends along the longitudinal axis 28 toward the central section 48. An outlet water orifice 42, formed in a threaded member 43 is secured in a cooperatively threaded axially oriented hole 43' of water injection member 40. As seen in FIGS. 2 and 4, the passage 45 is aligned with the longitudinal axis 28 of the bore 26 and faces the outlet end 31 of the bore 26.

Figure 3:
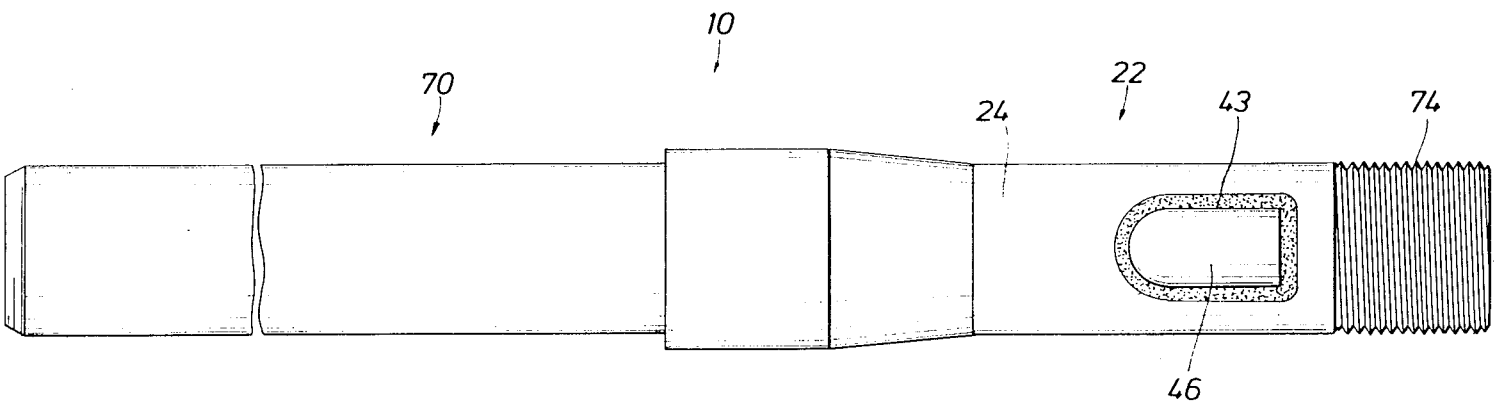
FIG. 3 is a side view of the propulsion chamber and an affixed outlet nozzle of FIG. 2, the side view oriented with the water inlet member facing outwardly from the plane of the drawing.

The water injection member 40 includes a radial passage 44 through which high pressure water is communicated to outlet orifice 42. A water inlet member is secured by welds 43 to the housing 24 about the water injection member 40 as illustrated in FIGS. 2, 3 and 5. A radial passage 44' in water inlet passage is aligned with radial passage 44 of water injection member 40. A threaded bore 76 formed approximately parallel with axis 28 of bore 26 is provided in water inlet member 46. Threaded bore 76 communicates with radial passage 44'. A male connector 79 attached to the end of pressurized water line 11 may be threadedly secured within threaded bore 76 as illustrated. A flow path for pressurized water runs from line 11 via threaded bore 76 to passages 44', 44 and along the axis 28 of bore 26 of propulsion chamber 22 via outlet orifice 42.

During manufacture of the propulsion chamber 22, the water injection member is first inserted within slots 80, 81 of the housing 25 and welded thereto by means of welds 41. The outside of the housing is then turned on a lathe until the outer surface of the housing is smooth. Pins 47 are inserted on one side of the water injection member in holes provided therefore as illustrated in FIG. 2. Receiving holes in water inlet member 46 cooperate to align properly the water inlet member 46 with the water injection member 40. Then welds 43 are made to secure water inlet member 46 to housing 24.

The outlet end 31 of bore 26 includes an inwardly sloping frusto-conical surface 66 at the end of the propulsion chamber 22. The end of the propulsion chamber 22 includes a female threaded counterbore 72 to accept a nozzle 70 have cooperatively threaded male threads 73 so as to connect with the propulsion chamber. Advantageously the inlet portion 80 of nozzle 70 has a frusto-conical surface 77 which slopes substantially the same—that is toward outlet end 100 as does frusto-conical surface 66 of propulsion chamber 22. As a result, the surfaces 66 and 77 cooperate to form a substantially uninterrupted inlet nozzle structure completed by throat section 83 and outwardly sloping frusto-conical surface 78 of nozzle 70.

For protection against the eroding effects of the wetted abrasive blast on the lagging side of the propulsion chamber and on the interior of the nozzle 70, protective inserts or coatings 101 and 102 may be advantageously provided on frusto-conical surfaces 66, 77 and 78 and within throat area 76. Similar coatings or inserts 103 may also be advantageously provided on the sides 55, 57, 58 of leading section 54. Such coatings or inserts may advantageously use ceramic or tungsten carbide as erosion resistant materials.

In operation, a substantially constant flow rate of air and abrasive is presented to the inlet end 30 of the propulsion chamber 22. The wing or air foil effect of the leading section 54 of the water injection member 40 causes the air/abrasive mixture to flow around the water injection member 40 and cause turbulent flow conditions past the lagging section 56 in the bore 26. High pressure water via line 11 and passages 44, 44' is applied coaxially toward the outlet end 31 of the bore through water outlet orifice. Extremely high water velocity from orifice 42 propels abrasive particles, while wetting them, toward the nozzle 70. As indicated above, frusto-conical surface 66 of the bore 26 cooperates with surface 77 to produce the inlet inwardly-sloping conical combined surfaces 66, 77. The venturi effect of inlets (surfaces 77, 66), throat 76 and outwardly sloping frusto-conical surface serves to increase the velocity of wetted abrasive out the end of nozzle with extremely high velocity. The output of high velocity wetted abrasive may be described as "jet flow".

Operational tests under substantially similar input air/abrasive flow rates, inlet water pressures, and orifice sizes show that significantly better cleaning performance rates result from the propulsion chamber 22, nozzle 70 assembly of propulsion apparatus 10 illustrated in FIG. 2 as compared with prior apparatus known to the inventors of this invention. It is believed that increased performance is due to the fact that the air/abrasive flow rate and pressurized water are coaxially applied to a propulsion chamber bore and to an outlet nozzle without having angular turns of either the water jet or the abrasive along the flow path. Increased performance is also due to the coaxial acceleration of the abrasive by the water jet along the center line of nozzle 70.

Description of a Second Embodiment of the Invention

FIGS. 6–9 illustrate an alternative or second embodiment of the propulsion chamber 222 according to the invention. A nozzle 270 may be connected to the outlet of propulsion chamber 222 by threads 272. Coupling 75 of line 12 has cooperating internal or female threads (not shown) for connecting air/abrasive line 12 to the male threads 274 of propulsion chamber 222. Like the first embodiment of the propulsion chamber described above, propulsion chamber 222 includes a generally tubular housing 224 having a bore 226 formed therein defining a longitudinal axis 228.

Figure 6:
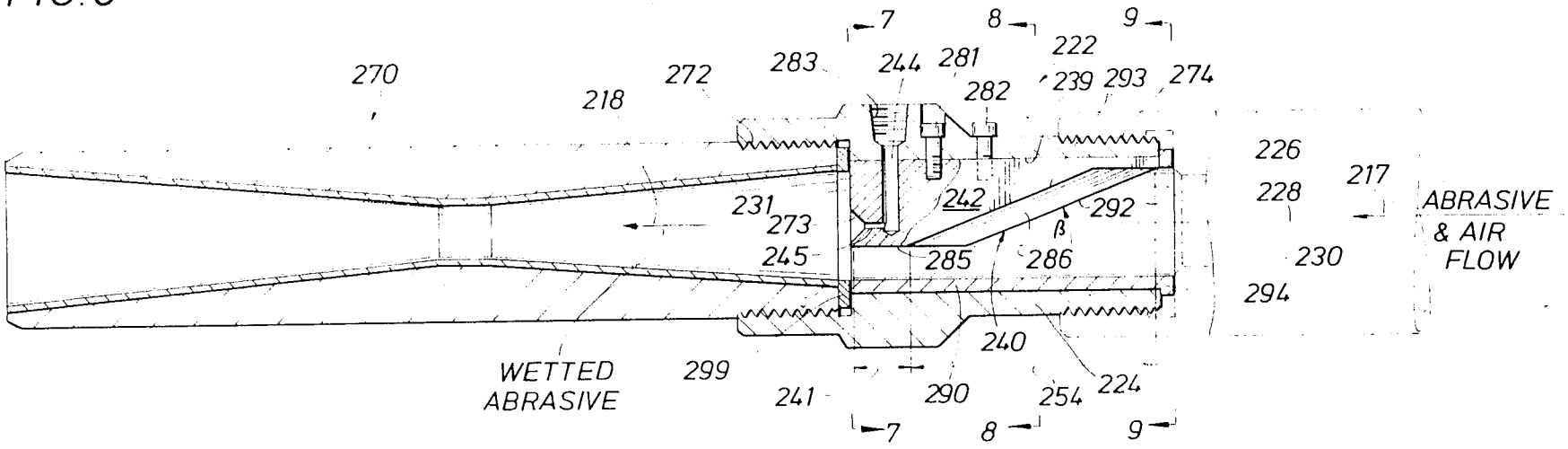
FIG. 6 is a cross-sectional view of a second embodiment of the propulsion chamber of the invention, showing a portion of the water injection member in a side view.
Figure 9:
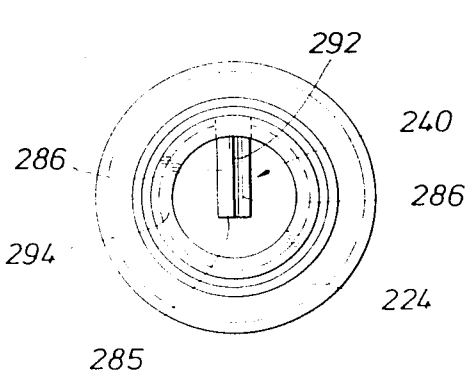
FIG. 9 is a cross-sectional view of the alternative embodiment of the invention, the view corresponding to the section lines 9—9 of FIG. 6 and further illustrating oblique surfaces facing the inlet and a downwardly sloping leading edge of the leading section of the water injection member.
Figure 8:
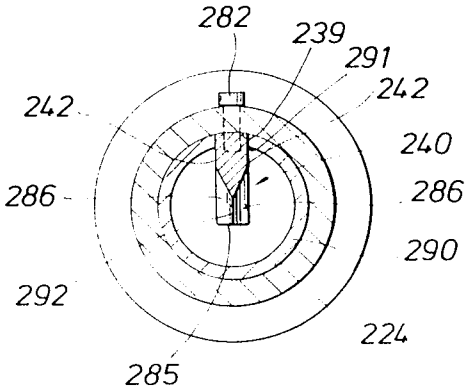
FIG. 8 is a cross-sectional view of the second or alternative embodiment of the invention, the view corresponding to the section lines 8—8 of FIG. 6 and illustrating oblique surfaces which face the inlet end of the housing bore.

The bore 226 of housing 224 is substantially straight defining a flow path for an entering flow of a mixture of abrasive and air as indicated by arrow 217 and a water propelled flow of wetted abrasive as indicated by arrow 218. Between the inlet end 230 and the outlet end 231, a water injection member 240 is secured in the bore 226 directly in the flow path of the entering mixture of abrasive and air. As best seen in FIGS. 6, 8 and 9, the cross-sectional area of water injection member which faces the bore flow path is small relative to that of the bore.

FIG. 6 illustrates a side view, partially in section of the water injection member 240 according to the second embodiment of the invention. The water injection member 240 can be divided (purely for description purposes) into a central section 241 and a leading section 254. Unlike the first embodiment of the invention described above, the water injection member has no lagging section.

Water injection member 240 has a bottom side 239 shown at an upper position in FIGS. 6–9 which is secured to a wall section of bore 226 of tubular housing 224. Bottom side 239 is secured to housing 224 by set screws 281, 282 through aligned bores in the housing 224 and water injection member 240. Additionally, the water injection member is secured to the housing 224 by applying adhesive to the bottom side 239 prior to securement by set screws 281 and 283. An epoxy adhesive such as "Matcote-113", a trademark of the International Paint Company, is preferred to adhere the water injection member 240 to tubular housing 224.

Figure 7:
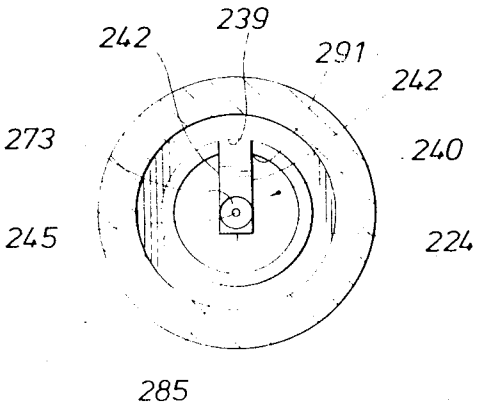
FIG. 7 is a cross-sectional view of the second embodiment of the invention, the view corresponding to the section lines 7—7 of FIG. 6 and illustrating that the water injection member of the alternative embodiment extends only partially into the bore of the housing.

A tubular wear liner 290 having a longitudinal slot 291, as best illustrated in FIGS. 7 and 8 is secured to the internal walls of the bore 226 about the lateral sides 242 of the water injection member 240. An epoxy adhesive such as "Matcote-113" described above is preferably used to secure wear liner 290 to the internal walls of bore 226 of housing 224. A cylindrical lip 294, integral with wear liner 290, covers the inlet cylindrical surface of tubular housing 224 of propulsion chamber 222.

Preferred construction of the propulsion chamber 222 calls for it to be fabricated of aluminum. The preferred material for water injection member 240 and liner 290 is primarily tungsten carbide. Specifically, the member 240 and liner 290 is formed from a sub-micron size powder mixture of 94 percent tungsten carbide with 6 percent cobalt binder. The powder is the put in a mold and pressed to approximate the shape of the water injection member 240 and the liner 290, illustrated in FIGS. 6–9. The member 240 and liner 290 are then maintained to provide holes and finished surfaces as known by those of skill in processing tungsten carbide materials. Although the preferred fabrication material for member 240 and liner 290 is tungsten carbide, such members may be fabricated of other erosion resistant materials such as ceramic or hardened steel.

The central section 241 of water injection number 240 includes a generally radially directed passage 244 through which high pressure water is communicated to a water outlet orifice 245 which is aligned with the longitudinal axis 228 of the bore 226 and which faces the outlet end 231 of the bore 226. A frusto-conical surface 273 is formed about the orifice 245 which faces the outlet end 231 of the bore 226. A threaded bore 282 in housing 224 is aligned with passage 244. A source of high pressure water may be provided via a suitable connection (not shown but similar to member 79 of FIG. 2) to threaded bore 283. Set screws 281 and 282 are provided as a backup means to the adhesive mentioned above to secure water injection member 240 to the tubular housing 224. Set screws 281, 282 are provided through aligned holes in the water injection members and housing. A gasket 299 is provided at the outlet end 231 of the bore 226 to abut nozzle 270 upon complete makeup of threads 272.

The leading section 254 of the water injection member slopes downwardly from the top side 285 of the central section 241 toward the bottom side 239 near the inlet end 230 of bore 226. Preferably, the slope as illustrated by the angle $\beta$ of FIG. 6 is about 20°, but slopes more or less than 20° may be used by artisans of skill. In general, angles less than 20° will demand a longitudinally longer propulsion chamber. Angles significantly greater than 20° affect the ultimate performance of the propulsion chamber 222 and nozzle 270.

The leading section 254 includes oblique surfaces 286 formed along the downwardly sloping part of the leading section 254. The oblique surfaces are complimentarily formed on lateral sides 242 of the water injection member such that two adjacent edges of the surfaces coterminate in edge 292 which obliquely faces the inlet end 230 of bore 226. The other sides of the surfaces 286 terminate in edges 293 in lateral sides 242 of member 240. Preferably, the surfaces are formed at approximately a 28° angle to a perpendicular section through the sloping edge 292.

Where viewed from the inlet end 230, the abrasive/air flow 217 sees an upwardly sloping edge 292 and oblique deflection surfaces 286 which are less than fifteen degrees to the longitudinal axis 228 or flow path 217. Surfaces of greater than fifteen degrees to axis 228 erode much faster than those of less than fifteen degrees.

The oblique deflection surfaces 286 cause any abrasive in the path of the water injection member 240 to deflect or ricochet into the air stream flowing through the bore 226 and around the member 240. The deflection angle must be small enough to allow the air/abrasive stream about the side of member 240 to cause the ricocheted abrasive particles to change their direction back to substantially coaxial flow prior to impact of the housing bore 226. Such action substantially eliminates wear of the bore due to high velocity abrasive particles and achieves substantially unidirectional flow of the abrasive particles and the air stream as it exits the bore 226 of the propulsion chamber 222. Consequently, the air/abrasive mixture is substantially coaxial with the high velocity water jet exiting orifice 245 prior to being propelled by the water jet in the blast nozzle 270.

Various modifications and alterations in the described invention will be apparent to those skilled in the art of the wet/abrasive blast apparatus which does not depart from the spirit of the invention. For example, the nozzle 70 of FIG. 2 of the first embodiment of the invention may be formed integrally with the propulsion chamber 22, or the frusto-conical surface 66 could be eliminated in favor of an inlet nozzle frusto-conical surface of appropriate length for the nozzle 70. Such changes are desired to be included in the appended claims. The appended claims recite the only limitation to the present invention. The descriptive manner which is employed for setting forth the preferred embodiments of the invention should be interpreted as illustrative and not limitative.

What is claimed is:

1. Propulsion apparatus adapted for use in a liquid propelled abrasive cleaning system comprising, a housing having a bore formed therein defining a longitudinal axis, said bore having an inlet end and an outlet end, said bore being substantially straight to define a path of a flow of air and abrasive to said bore from said inlet end of said bore, and injection means for injecting high pressure water substantially coaxially in said bore toward said outlet end, said injection means disposed in said path of said flow of air and abrasive downstream from said inlet end of said bore and including a water injection member having a central section and a leading section, said central section having lateral sides which are substantially parallel to each other, the distance between said lateral sides of said central section defining a central section width, the longitudinal distance of said lateral sides defining a central section length, said leading section facing said inlet end of said bore and having leading lateral sides which angle inwardly respectively from said central section lateral sides toward said longitudinal axis of said bore, said leading lateral sides terminating at a leading side facing said inlet end of said bore, said lateral sides of said central section and of said leading section each having top and bottom ends which are secured to radially opposite walls of said bore, the longitudinal distance of said leading lateral sides of said leading section between said leading side and said central section defining a leading section length which is substantially greater than said central section length, said leading side being of a width which is substantially smaller than said central section width, whereby the shape of said leading section operably facilitates said flow of air and abrasive around the lateral sides of said central section of said water injection member, said water injection member having an outlet orifice disposed substantially coaxially with said bore of said housing, said water injection member having a radially directed passage communicating with said outlet orifice, said housing having water inlet means communicating with said radially directed passage and operably adapted to receive high pressure water, whereby said high pressure water propels said flow of air and abrasive through said outlet end.

2. The apparatus of claim 1 wherein said water injection member includes:

a lagging section disposed toward the outlet end of said bore, said lagging section having lateral sides which angle inwardly respectively from said central section lateral sides toward said longitudinal axis of said bore.

3. The apparatus of claim 2, wherein said lateral sides of said lagging section terminate at a lagging side disposed toward said outlet end from said central section.

4. The apparatus of claim 3 wherein, said lagging side of said lagging section includes a slot formed therein, said slot opening at said lagging side of said lagging section nd extending toward said central section generally parallel to said longitudinal axis of said bore, and wherein said outlet orifice is placed in said slot and is directed toward said outlet end of said bore.

5. The apparatus of claim 1 wherein said outlet end of said bore includes a frusto-conical surface which slopes towards said longitudinal axis.

6. The apparatus of claim 5 further comprising a nozzle connected to the outlet end of said bore of said housing.

7. The apparatus of claim 5 wherein said cylindrical housing includes a counterbore in the outlet end thereof, and further comprising an outlet nozzle that has an inlet portion removably secured within said counterbore.

8. The apparatus of claim 6 wherein said outlet nozzle includes an inlet inwardly directed frusto-conical surface which cooperates with said inwardly directed frusto-conical surface from said outlet of said bore of said housing to said inlet of said outlet nozzle.

9. The apparatus of claim 1 wherein said water inlet means includes an outwardly extending inlet member fixed to the outer surface of said housing about said radially directed passage of said water injection member, said inlet member having a radial passage communicating with said radially directed passage of said water injection member, said inlet member having an inlet bore communicating with said inlet member radial passage, said inlet bore being adapted to receive pressurized water.

10. Propulsion apparatus adapted for use in a liquid propelled abrasive cleaning system comprising a housing having a bore formed therein defining a longitudinal axis, said bore having an inlet end and an outlet end, said bore being substantially straight to define a path for a flow of air and abrasive to said bore from said inlet end of said bore, said bore characterized by a bore diameter, water injection means for injecting high pressure water substantially coaxially in said bore toward said outlet end, said water injection means including a water injection member having a bottom side secured to a wall of said bore, said injection member having a top side which is positioned in said path for a flow of air and abrasive beyond said longitudinal axis of said bore, said water injecting member having a height less than said bore diameter, said water injection member having an outlet orifice disposed substantially coaxially with said bore of said cylindrical housing, said water injection member having a generally radially directed passage communicating with said outlet orifice which is adapted to receive high pressure water.

11. The apparatus of claim 10 wherein said water injection member has, a central section through which said radially directed passage is disposed, said central section having a top side which extends diametrically upwardly from said bottom side into said path for a flow of air and abrasive beyond said longitudinal axis of said bore, and a leading section which slopes from said top side of said central toward said inlet end of said bore and toward said bottom side of said injection member.

12. The apparatus of claim 11 further including a cylindrical liner secured to the surface of said bore, said liner having a longitudinal slot in which said bottom side of said water injection member is disposed.

13. The apparatus of claim 12 wherein said cylindrical liner is fabricated of tungsten carbide.

14. The apparatus of claim 10 wherein said water injection member is fabricated of tungsten carbide.

15. The apparatus of claim 12 wherein said leading section slops from said top side of said central section toward said inlet end of said bore, such sloping terminating at said liner.

16. The apparatus of claim 15 wherein said leading section includes complementary oblique surfaces formed therein, said surfaces defining a leading edge of said leading section which slopes from said top side of said central section toward said inlet end of said bore and toward said bottom side of said injection member.

17. The apparatus of claim 15 wherein said leading section head two lateral surfaces which extend into said bore from said bottom side, and said leading section includes two complimentary oblique surfaces formed therein, each of said surfaces having a side with terminates with a side of the other surface to form a downwardly sloping leading edge of the leading section, each of said oblique surface having a side which forms an edge in one of said two lateral surfaces.

* * * * *